US010918935B2

(12) United States Patent
Takacs et al.

(10) Patent No.: US 10,918,935 B2
(45) **Date of Patent: *Feb. 16, 2021**

(54) CASINO TABLE GAME APPARATUS AND METHOD

(71) Applicants: Dawn L. Takacs, Weirton, WV (US); William Eugene Takacs, Jr., Weirton, WV (US)

(72) Inventors: Dawn L. Takacs, Weirton, WV (US); William Eugene Takacs, Jr., Weirton, WV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/587,186

(22) Filed: Sep. 30, 2019

(65) Prior Publication Data

US 2020/0054934 A1 Feb. 20, 2020

Related U.S. Application Data

(63) Continuation of application No. 15/893,777, filed on Feb. 12, 2018, now Pat. No. 10,427,027.

(60) Provisional application No. 62/458,401, filed on Feb. 13, 2017.

(51) Int. Cl.

| | |
|---|---|
| ***A63F 9/04*** | (2006.01) |
| ***A63F 3/00*** | (2006.01) |
| ***A63F 11/00*** | (2006.01) |
| ***G07F 17/32*** | (2006.01) |
| *A63F 1/06* | (2006.01) |

(52) U.S. Cl.

CPC ..... *A63F 3/00157* (2013.01); *A63F 11/0074* (2013.01); *G07F 17/32* (2013.01); *G07F 17/322* (2013.01); *G07F 17/326* (2013.01); *A63F 1/067* (2013.01); *A63F 9/04* (2013.01); *A63F 9/0406* (2013.01); *A63F 2003/00164* (2013.01); *A63F 2009/0411* (2013.01); *A63F 2009/0486* (2013.01); *A63F 2011/0088* (2013.01)

(58) Field of Classification Search

CPC ... A63F 9/04; A63F 9/0406; A63F 2009/0411
USPC ..... 273/145 A, 145 B, 145 R, 144 A
See application file for complete search history.

(56) References Cited

U.S. PATENT DOCUMENTS

| | | | | |
|---|---|---|---|---|
| 2,628,840 A * | 2/1953 | Laube, Jr. | ..... | A63F 9/0406 273/145 A |
| 3,645,533 A * | 2/1972 | Lester | ..... | A63F 9/0406 273/145 A |
| 10,427,027 B2 * | 10/2019 | Takacs | ..... | G07F 17/326 |

* cited by examiner

*Primary Examiner* — Benjamin Layno
(74) *Attorney, Agent, or Firm* — David G. Oberdick

(57) ABSTRACT

A dice cup used for rolling dice and randomizing the markings shown on the upper side of dice. The dice cup has a flat base and a circumferential side wall that forms a hollow annular shape with a top aperture and that attaches to the base to form a closed bottom. The diameter of the bottom is greater than the diameter of the aperture, whereby the circumferential side wall tapers outward from the aperture to the closed end. Rolling and randomization of the markings on the upper side of the dice is caused by interaction between the dice and (1) protrusions extending upward from the upper surface of the base that have a predetermined size that cause the one or more cubic dice placed inside the dice cup to rest on the corners of each dice, and/or (2) raised surface features on the tapered interior of the side wall.

7 Claims, 4 Drawing Sheets

CASINO TABLE GAME APPARATUS AND METHOD

CROSS-REFERENCE TO RELATED APPLICATIONS

The present application is a Continuation of application Ser. No. 15/893,777 filed Feb. 12, 2018 which claims the benefit of U.S. Provisional Patent Application Ser. No. 62/458,401 filed Feb. 13, 2017, entitled "Casino Table Game Apparatus and Method," all of which are incorporated by reference herein in its entirety.

The application generally relates to a casino table game board and gaming method. The application relates more specifically to a semi-circular casino table game with unique die and/or a deck of playing cards for placing wagers, and rules for executing wagers using the game pieces.

Casino table games such as baccarat, blackjack, craps and roulette are traditionally popular means of entertainment. However, some table games require a large number of players and can have complex rules that make the respective games and bets difficult to understand and play.

In order to play craps, players are required to stand. The disclosed table game does not require players to stand when playing the game. Most craps wagers must be booked verbally by player/dealer confirmation. This verbal process often creates a language barrier, or confusion for players that do not speak the dealer's language. Many of the wagers associated with the disclosed casino game are player-controlled betting areas and include bets that are easy to read, comprehend and play.

What is needed is a system and/or method that satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY

One embodiment relates to a casino table game including a table surface having markings thereon for identification and placement of wagers entered by a plurality of players, a plurality of cube-shaped dice comprising a first pair of dice including traditional dot markings on each of six surfaces of each die, a second pair of cube-shaped dice, each die cube having a single alpha symbol "Y" or "O" on one cube surface in an embodiment, or both symbols displayed on opposing sides of the cube in another embodiment, and the remaining sides blank; wherein wagers are place according to a set of predefined wagering rules associated with the markings identified on the table surface, the markings comprising: [LOW] (4,5,6) pays out odds of 3 to 2; [HIGH] (8,9,10) pays out odds of 3 to 2; [2,3,12] pays out odds of 7 to 1; and [11] pays out odds of 15 to 1; [PAIRS]—(3/3 or 4/4), and (2/2 or 5/5), or pairs may be combined into one bet, same placement with odds of 7 to 1.

Another embodiment relates to a method of wagering on a dice and/or card game comprising the steps of presenting a dice cup having four dice, two casino dice and two alpha dice, to a player; expelling the dice onto a designated surface identified as a gaming layout or a dice landing tray; Wherein if a player rolls a (7) or (11) on the dice throw, a [PLAY] bet ties on a (7) roll and pays 4 to 1 on an (11) roll; and if a player rolls a (2), (3) or (12), all [PLAY] bets will lose; and continuing to submit wagers by players until the shooter establishes a point by rolling one of the following numbers: (4), (5), (6), (8), (9), or (10); establishing a point from the group (4), (5), (6), (8), (9), or (10), repeating the step of rolling the dice until one of the following events occurs: repeating the same point, a (7), or a 7-out, is rolled; wherein rolling the marked point wins for bets placed on the [PLAY] and the [MORE]; and all wagers losing If the shooter rolls a (7) after the marked point is established, lost wagers after a (7) roll including: [PLAY], [MORE], [BONUS], [LATE PLAY], [2,3,12], [HIGH], [LOW], [11] and [PAIRS]; and wherein rolling a Y and an O for the alpha dice during a 7-out roll is an exception to the losing bet and wherein any Y and O rolled along with a 7-out resulting in a tie or push, and the [BONUS] bet staying up to win, and all other wagers losing on a 7-out; and players may wager more on the established point by making a wager on the [MORE] bet and take odds equal to or up to 10 times their original [PLAY] bet, (or per gaming regulations, per market place) by placing a wager on the [MORE] betting circle. Once placed, the [MORE] wager becomes a contract bet and cannot be removed or changed until a win/loss of the [PLAY] is determined by the dice (or playing cards in jurisdictions where playing cards are used instead of dice.) Any [MORE] wagers placed will be paid accordingly for these points: 4 and 10 [MORE] pays 2 to 1, 5 and 9 [MORE] pays 3 to 2, 6 and 8 [MORE] pays 6 to 5.

Still another embodiment discloses a casino table game. The table game includes a table surface having markings thereon for identification and placement of wagers entered by a plurality of players. A first pair of dice and a second pair of cubic dice are provided. Each die of the first pair of dice and second pair of dice including unique markings on each surface of six surfaces die to indicate a unique integer value from 1 to 6. One or more wagers may be placed according to a set of predefined wagering rules associated with a plurality of markings identified on the table surface. The markings corresponding to a total sum of dot markings displayed on a roll of the first pair of dice, the markings include the following: [PAIRS]; [LOW] (4, 5 or 6); [HIGH] (8,9,10); [2,3,12]; and [11].

Certain advantages of the embodiments described herein are a wagering game played with fewer than one-third of the bets of a traditional craps game which simplifies it. Further, completely unique bets are added, and the game is played with four dice in play instead of two. A table surface includes a semi-circular segment that provides selections for betting on specific combinations of dice.

Also a pair of alpha dice is included that ensures that a dice shooter has no control over the dice once the dice are inserted into the cup.

Alternative exemplary embodiments relate to other features and combinations of features as may be generally recited in the claims.

BRIEF DESCRIPTION OF THE FIGURES

The application will become more fully understood from the following detailed description, taken in conjunction with the accompanying figures, wherein like reference numerals refer to like elements, in which.

DETAILED DESCRIPTION OF THE EXEMPLARY EMBODIMENTS

Before turning to the figures which illustrate the exemplary embodiments in detail, it should be understood that the application is not limited to the details or methodology set forth in the following description or illustrated in the figures. It should also be understood that the phraseology and terminology employed herein is for the purpose of description only and should not be regarded as limiting.

Figure 1:
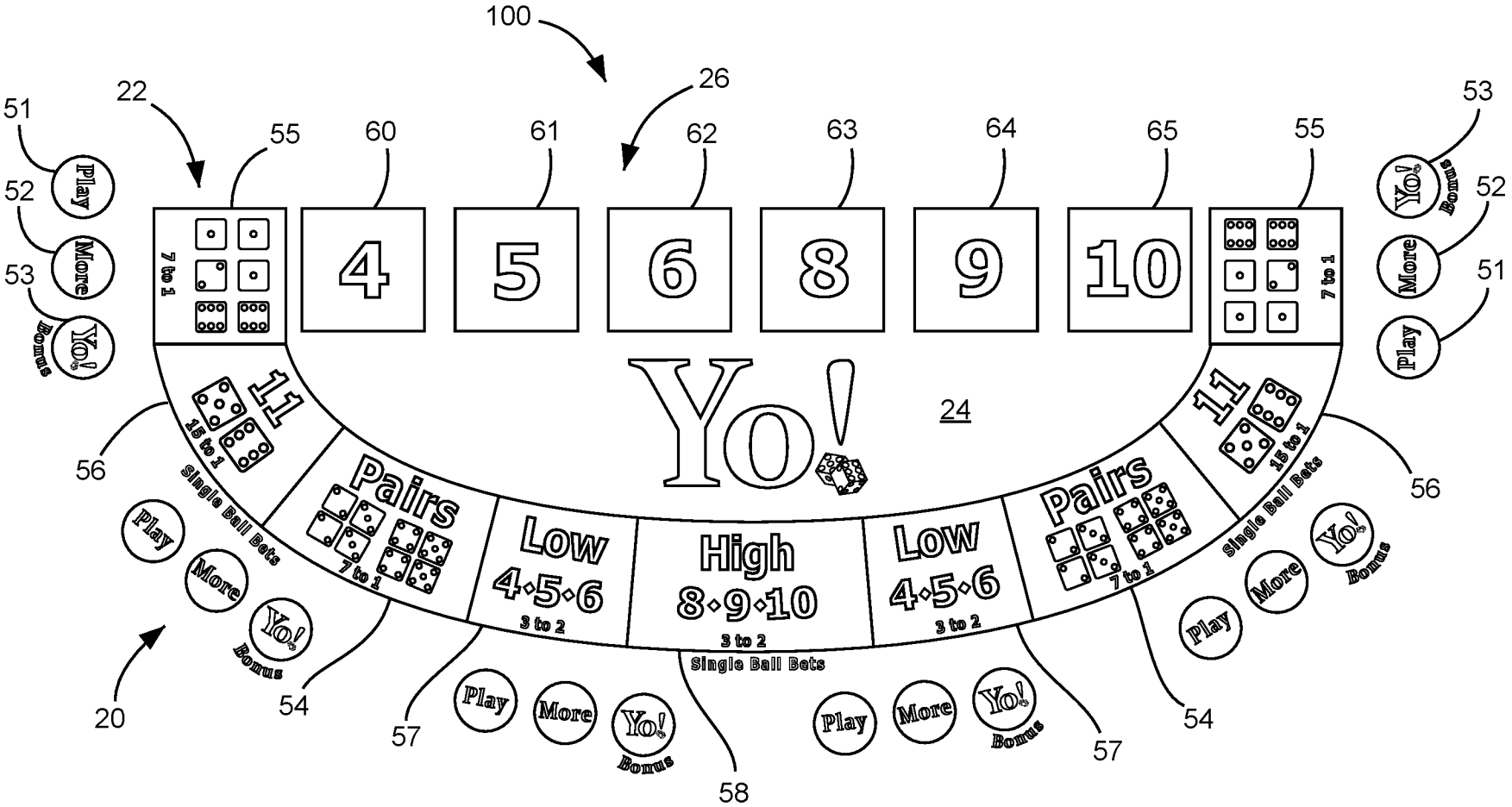
FIG. 1 is a plan view of an exemplary game board for a casino table game.

Referring to FIG. 1, a board game playing surface 100 has a semi-circular plan divided into several regions. An outer perimeter area includes spaces 20 for six or seven players, each space 20 including three medallions 51, 52 and 53 for selecting a play status, i.e., "[MORE]" 52, [PLAY] 51 and [BONUS] 53. The game is played with fewer than one-third of the bets of a traditional craps game which simplifies it. Further, completely unique bets are added, and the game is played with four dice in play instead of two. The first semi-circular segment 22 provides selections for betting on specific combinations of dice. Any roll of dice resulting in a pair showing, indicated as [PAIRS] 54, any roll of dice resulting in a total of 2, 3 or 12, indicated as [2-3-12] 55, a dice roll totaling eleven, indicated as [11] 56, any dice roll resulting in one of the low numbers 4, 5 or 6, indicated as [LOW] 57, and any dice roll resulting in one of the high numbers 8, 9 or 10, indicated as [HIGH] 58. Ribbon 22 is symmetrical about the center segment 58. A central region 24, indicated by a logo, e.g., [Yo!], a casino logo, or other design mark, is arranged between the first semi-circular segment 22 and a connecting segment 26 extending between opposite ends of segment 22. Connecting segment 26 includes six sections 60 through 65, for placing [LATE PLAY] bets, each having a numerical reference corresponding to a bet on a specific outcome, and for marking the established point or placing a [LATE PLAY] wager. It should be noted that the name Yo! is a trademark of the inventor, and is used throughout to indicate the title of the game.

Figure 3:
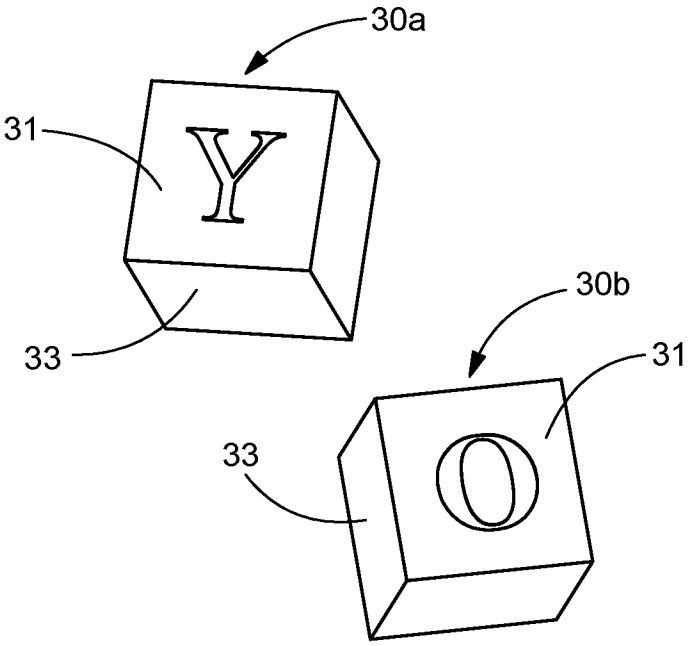
FIG. 3 illustrates two die pieces, each having one or two alpha characters displayed on one or two sides, respectively of the cubic die piece (e.g., "Y" or "O").
Figure 2:
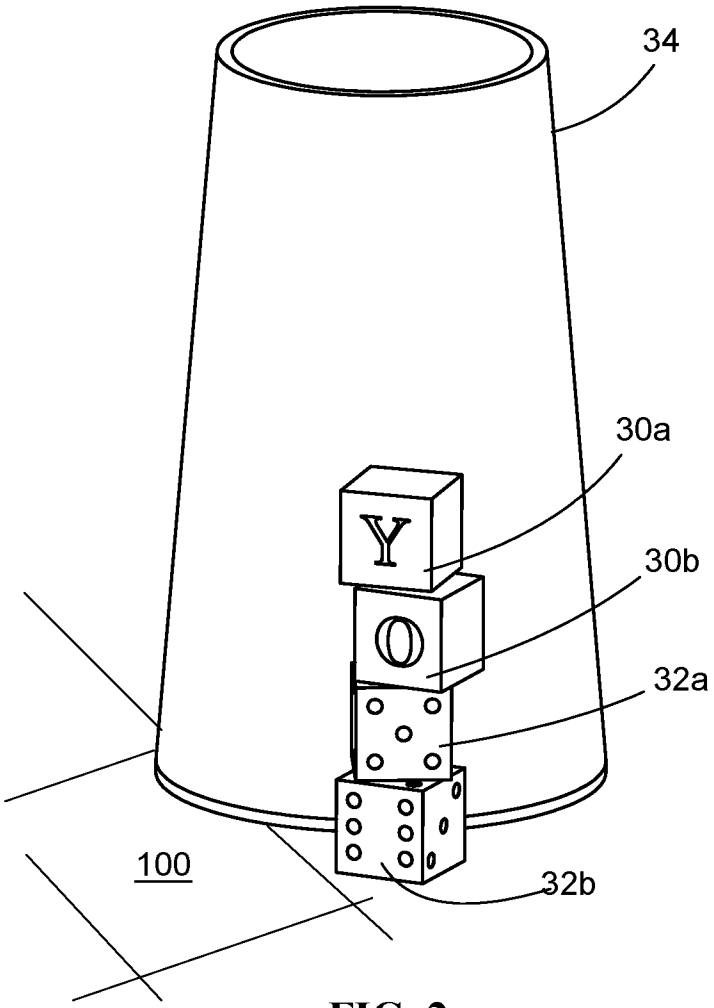
FIG. 2 illustrates a set of four die pieces for use in playing the board game.

Referring next to FIG. 2 an exemplary set of four die pieces for use in playing the board game is shown. Alpha dice 30*a*, 30*b*, are shown stacked on top of conventional dice 32*a*, 32*b*, and positioned in front of a dice cup 34 on the board surface 100. Alpha dice 30*a*, 30*b*, are cubes having six sides, only one of which includes an alpha character displayed thereon, and the remaining five sides are left blank, e.g., solid white surfaces. Thus, any throw of the four dice may result in one, two or none of the alpha characters facing up. FIG. 3 is another illustration of the alpha dice 30*a*, 30*b*, showing an alpha surface 31 on each die, and blank surfaces 33 on the remaining sides. It is understood that the opposite sides not visible in FIG. 3 are also blank surfaces. The word "YO" may be spelled out when both alpha surfaces are facing upwards after a throw of the dice. In another embodiment of the game, each of the alpha dice 30*a*, 30*b* will have a letter on two opposing sides of the six-sided cube, displaying the same letter. In this embodiment there will only be four blank sides on each of the dice 30*a*, 30*b*.

The basic game rules are described as follows. Every player must select either a [PLAY] (or if entering the game post-point established a [LATE PLAY]), by placing gaming chips on the medallion marked 51, (or Late Play area 60, 61, 62, 63, 64, 65). The game has one contract wager of the [PLAY], with another optional bet of [MORE] which is located right next to the [PLAY] betting circle. Players may elect to take odds by wagering on the [MORE] after a point [selected from one of: (4, 5, 6, 8, 9, 10)] has been established by a throw of the dice, and only if the player already has placed a [PLAY] wager. (Note the coming out roll may result in a 7,11,2,3,12 or other non-point roll—the 'coming out roll' refers to the beginning of the game play, not necessarily a roll that establishes a point, to clarify) Additionally a 'contract bet' by casino rules is any wager that stays in play until an outcome is determined win/or loss, Play and More—both become contract bets once placed, as does the Bonus. Once the [PLAY] and [MORE] wagers, or bets, are placed, both bets will become irrevocable contract bets and cannot be modified or removed until a game outcome is determined. The [PLAY] bet must meet table minimum wager requirements, and the [MORE] wager, minimum and maximum wagers may vary based on each venue and/or marketplace. The game play may vary, e.g., from a minimum of 1× to 10× odds for the [MORE] wager, although suggested limits may be larger or smaller.

Once players place a [PLAY] and/or [MORE] bet, the dice cup is to be presented to a player, called the shooter. The shooter may be selected from the seated players in order, e.g., beginning with the first seated player left of the dealer. The shooter must have placed a [PLAY] bet to take possession of the dice cup. The dealer will drop all four of the die into a dice cup.

In one embodiment, the game may be played according to the following set of rules using the game pieces as described above.

Under the Basic Game Rules for the Dice, the concept of determining the call is based on each roll of the dice. The dealer will present a dice cup to the shooter with four dice. The designated shooter rolls all four dice, at once. Dice 32*a*, 32*b* are standard casino dice, and the remaining pair is alpha dice 30*a*, 30*b*. The alpha dice 30*a*, 30*b*, are uniquely designed to be a specific element of play in this game, while also increasing protection and integrity of play. In one embodiment each player may use four separate dice 30*a*, 30*b*, 32*a*, 32*b*, with one dice cup 34 for each roll. Of the four dice presented to the player, two of the dice, (Set 1), are normal casino dice with pips, or dots, totaling 1, 2, 3, 4, 5 and 6 on each of six sides of the respective dice. The other alpha dice are specifically designed 6-sided dice, in the same size and shape as the casino dice, but having five blank sides. The sixth side of the alpha dice has one alpha letter on each die. One of the die shows a 'Y' on the sixth side and the other die has an 'O' on the sixth side. All other sides of the alpha dice 30*a*, 30*b*, are blank, In the embodiment described above in which the dice 30*a*, 30*b* have two sides displaying an alpha character there will only be four blank sides on each dice 30*a*, 30*b*.

The object of the alpha dice is to ensure that shooter has no control over the dice once the dice are inserted into the cup, and will determine the [BONUS] wagers outcome, win or loss. Before every dice roll, the dealer will place all four dice,—two casino dice 32*a*, 32*b*, and two alpha dice 30*a*, 30*b*—into the dice cup 34 and present the cup to 'the shooter.' By rule, in an embodiment the player/shooter must shake the cup 34, e.g., three or more times before releasing the dice to a designated area on the game surface. The designated shooting area—e.g., the area 24 where the Yo!™ logo is displayed—may be located on the gaming board 100 or a special dice landing platform. The sum of the standard casino dice roll establishes 'the call' for the current round of play. The second set of alpha dice are only considered when both the Y and the O are facing up at the same time. When a Y/O rolls, players that wagered on the (Yo! [BONUS] 53 bet after a point is established, when the Yo! rolls are paid a bonus amount. the table minimum for a [LATE PLAY] instead of the required table minimum on the [PLAY] bet, may also play a [BONUS] (or Yo!) wager, and all other wagers except for [MORE].

To begin, a dealer may present the dice cup to the player, and the player may expel the dice onto the designated area after first shaking the cup, e.g., a minimum of three times. The designated area (not shown) may be the gaming board 100 or a dice landing tray. If a player rolls a (7) on the first throw/roll of the dice, all [PLAY] bets result in a tie, or push. If a player rolls (11), all [PLAY] bets are paid 4 to 1. If a player rolls a (2), (3) or (12), all [PLAY] bets will lose. Players may continue to wager accordingly, until the shooter establishes a point by rolling one of the following numbers: (4), (5), (6), (8), (9), or (10). The dealer will mark the newly established point with a puck/button showing the 'On' side of the On/Off puck, or alternately, a YES/NO puck.

Once the shooter establishes a point from the group (4), (5), (6), (8), (9), or (10), the shooter will continue to roll the dice until either the point or a (7), (also called a 7-out), is rolled. Rolling the marked point wins for bets placed on the [PLAY] 51 and the [MORE] 52. If however the shooter rolls a (7) after the marked point is established, all wagers will lose. Lost wagers after a (7) roll includes: [PLAY] 51, [MORE] 52, [BONUS] 53, [LATE PLAY] 60, 61, 62, 63, 64, 65, [2,3,12] 55, [HIGH] 58, [LOW] 57, [11] 56 and [PAIRS] 54. Any roll of the alpha dice of a Y and an O during a 7-out roll is the only exception; any Y/O rolled together with a 7-out results in a push, and the [BONUS] 53) bet will stay up to win again.

[MORE]—Players may take odds equal to or up to 10 times their original [PLAY] bet, or up to the limit imposed by local gaming regulations, by placing a wager on the [MORE] betting circle. Once placed, the [MORE] wager becomes a contract bet and cannot be removed or changed until a win/loss of the [PLAY] is determined by the dice (or playing cards in jurisdictions where playing cards are used instead of dice.) Any [MORE] wagers placed will be paid accordingly for these points:

4 and 10 [MORE] pays 2 to 1
5 and 9 [MORE] pays 3 to 2
6 and 8 [MORE] pays 6 to 5

Single Roll Bets—Displayed on arcuate segment 22 are separate Single Roll Bet options. The single roll wagers have no relevance to the point, and are independent of any other wagers. All single roll betting options are controlled by the respective player, or self-serviced wagers. Self-serviced means that the respective player is responsible for placing wagers or taking their winnings. Dealers do not place wagers for self-serviced wagers. Self-serviced wagers are indicated along arc segment 22 on the table 100 and include: [PAIRS] 54, [2,3,12] 55, [HIGH] 58, [LOW] 57 and, [11] 56. Wagering odds may be preferably displayed on the table surface 100 and are set forth below. It should be noted, each casino establishment may will structure these odds to be competitive within their marketplace, while meeting with gaming compliance.

[LOW] (4, 5 or 6) pays out odds of 3 to 2;
[HIGH] (8,9,10) pays out odds of 3 to 2;
[2,3,12] pays out odds of 7 to 1;
[11] pays out odds of 15 to 1; and
[Pairs] 2/2, 3/3, 4/4, 5/5 pays out odds of 7 to 1

[PAIRS] 54 Single roll bets include combinations of the dice rolled as 2/2, 3/3, 4/4, 5/5, betting areas are duplicated in both spots 54, both are single roll wagers paying odds of 7 to 1.

[LATE PLAY]—([LATE PLAY]) or the wager boxes of (4,5,6,8,9,10)

[LATE PLAY] is the only wager controlled by the dealer. It is a courtesy bet for a player to enter the game after a point has been established. The [LATE PLAY] becomes a contract bet and cannot be edited or removed once it is placed.

Payouts for Place Bets

1. [LATE PLAY] 4 and 10 pays 9 to 5
2. [LATE PLAY] 5 and 9 pays 7 to 5
3. [LATE PLAY] 6 and 8 pays 7 to 6

The game the dice game consists of nine distinct wagers, or bets, as follows:

1. PLAY]
2. [MORE]
3. the game [BONUS] (or [Yo!)
4. [PAIRS] 2 and 2, 3 and 3, 4 and 4, and 5 and 5 (two Betting Areas)
5. 2,3,12 (two Betting Areas)
6. Eleven [11] (two Betting Areas)
7. [LOW] 4,5,6 (two betting Areas)
8. [HIGH] 8,9,10
9. [LATE PLAY] (only after a point has been established)

The [BONUS] 53—is an optional wager; gaming table minimum and maximum payouts will vary by casino house rules. The [BONUS] 53 wager must be placed immediately after a point is established, and requires a previous [PLAY] bet, or a [LATE PLAY] in action if a player enters the game after a point has been established. A [BONUS] 53 wins, i.e., a payout is paid to every bonus wager, when both the Y and the O alpha dice roll collectively. Based on probabilities, the payouts for wagers are as follows:

Y/O dice rolled with an 11 pays 20 to 1 Y/O
dice rolled with any pair pays 4 to 1
Y/O dice rolled with any other combination of the dice pays 1 to 1
(Note that the odds given above are examples only and may be modified within the scope of the present invention)

The [BONUS] 53 wager is paid every time the alpha dice roll a Y and O simultaneously, even if a '7-out' is rolled by the casino dice. [BONUS] 53 loses only when a '7-out' rolls without a simultaneous alpha dice roll of Y/O.

Alternate Embodiment with Two Pair of Conventional Dice

In an alternate embodiment, the dice game may be played using a total of two pair of conventional dice, wherein one pair replaces the alpha dice described above. The game table includes main betting options labeled [Play], [More], and [YO!] that are resolved over multiple rolls, along with a variety of one roll wager options. Players must place an active Play wager (or a Late-Play wager) in order to place any other wagers. A first dice pair are the Game Dice, and the second dice pair are the Bonus Dice. The game commences with players placing bets on the Play wager as set forth Table 1 below. Play wagers must remain on the table until the round is resolved if the initial roll sets a point.

TABLE 1

| Play Wager Summary | | |
|---|---|---|
| Initial Game Dice | Outcome | Payout |
| 11 | Win | 4 to 1 |
| 7 | Push | — |
| 2, 3, 12 | Lose | — |
| 4, 5, 6, 8, 9, 10 | Point Set | — |

When a point has been set after the initial roll, players may place bets on the optional [More] wager. Like the [Play] wager, the [More] wager cannot be modified or removed until its outcome has been determined. The dice are rolled until either a 7 is rolled in the Game Dice, which results in a loss for the [Play] and [More] wagers, or the point has been rolled, which results in players being paid 1 to 1 for the [Play] wager. Results for the [More] wager are set forth below in Table 2. The [More] wager may be placed immediately after the point is set, provided the player has made a previous [Play] wager, and cannot be placed after subsequent rolls. In one embodiment the size of the [More] wager may be limited based on the amount of the respective player's [Play] wager.

TABLE 2

| More Wager Summary | |
|---|---|
| Point Set | Payout |
| 4 | 2 to 1 |
| 5 | 3 to 2 |
| 6 | 6 to 5 |
| 8 | 6 to 5 |
| 9 | 3 to 2 |
| 10 | 2 to 1 |

The YO! wager may be placed either before the initial roll or immediately after the point is set. The YO! wager is only considered active after an initial point has been set. While the YO! wager is active, players who have placed the YO! wager will receive a payout every time an 11 is rolled on the Bonus Dice according to Table 3, below.

TABLE 3

| YO! Wager Payouts | | |
|---|---|---|
| Bonus Dice Result | Game Dice Result | Payout |
| 11 | 11 | 20 for 1 |
| 11 | Pair | 4 for 1 |
| 11 | All Others | 1 for 1 |

The YO! wager loses the bet when a 7 is rolled before the point comes up on the Game Dice. If a 7 is rolled on the Game Dice at the same time as an 11 is rolled on the Bonus Dice, the wager is instead returned to the player, but the player will not be paid an equal amount to their YO! wager for an 11 being rolled on the Bonus Dice. If the point comes up before a 7 on the Game Dice, the YO! wager will be returned to the player.

The game also consists of five additional wagers set forth in Table 4, below. The additional wagers can be placed at anytime during the game and are resolved after each roll.

TABLE 4

| Side Wager Summary | |
|---|---|
| Game Dice Roll | Payout |
| [HIGH] 8, 9, 10 | 3 to 2 |
| [LOW] 4, 5, 6 | 3 to 2 |
| Pairs (2/2, 3/3, 4/4, | 7 to 1 |
| 5/5) | 15 to 1 |
| 11 | 7 to 1 |
| 2, 3, 12 | |

In an embodiment, players who join the game after the initial point has been set may place a Late-Play wager. The Late-Play wager will win the respective bet if the point comes up before a 7, and will otherwise lose. The Late-Play wager payouts are set forth in Table 5 below. Late-Play wagers cannot be removed. Players who place Late-Play wagers are not eligible to place the More wager, but may place other side wagers.

TABLE 5

| Late-Play Wager Summary | |
|---|---|
| Game Dice Roll | Payout |
| 4 | 9 to 5 |
| 5 | 7 to 5 |
| 6 | 7 to 6 |
| 8 | 7 to 6 |
| 9 | 7 to 5 |
| 10 | 9 to 5 |

Mathematical Analysis

The mathematical analysis for YO! using probability theory is set forth below in Tables 6 and 7, including a summary of probabilities for the Play and More wagers, respectively.

TABLE 6

| Play Wager Probability Summary | |
|---|---|
| Game Dice Total | Probability |
| 11 | 0.0556 |
| 7 | 0.1667 |
| 2, 3, 12 | 0.1111 |
| 4, 5, 6, 8, 9, 10 | 0.6667 |

TABLE 7

| More Wager Probability Summary | |
|---|---|
| Point Set | Probability of Point Before 7 |
| 4 | 0.3333 |
| 5 | 0.4000 |
| 6 | 0.4545 |
| 8 | 0.4545 |
| 9 | 0.4000 |
| 10 | 0.3333 |

Using the probabilities set forth above in Table 6 and Table 7, a House Edge (HE) of 1.41% and Return to Player (RTP) of 98.59% can be determined for the Play wager. A combined HE and RTP may be calculated for various examples of possible [More] wager amount as a multiple of the base Play wager, summarized by Table 8. The RTP will approach 100% as the amount of the More wager increases.

TABLE 8

| Play + More Wager HE and RTP Summary | | |
|---|---|---|
| More Wager | HE | RTP |
| 1 | 0.82% | 99.18% |
| 2 | 0.58% | 99.42% |
| 3 | 0.45% | 99.55% |
| 5 | 0.31% | 99.69% |
| 10 | 0.17% | 99.83% |
| 100 | 0.02% | 99.98% |

The YO! wager may be determined for each Point set by the Game Dice as set forth below in Table 9.

TABLE 9

| YO! Wager HE and RTP Summary | | |
|---|---|---|
| Point Set | HE | RTP |
| 4 | 9.88% | 90.12% |
| 5 | 8.89% | 91.11% |
| 6 | 8.08% | 91.92% |
| 8 | 8.08% | 91.92% |
| 9 | 8.89% | 91.11% |
| 10 | 9.88% | 90.12% |

The summary of the Side and Late-Play wagers for YO! is set forth below in Table 10 and Table 11, respectively.

TABLE 10

| Side Wager HE and RTP Summary | | |
|---|---|---|
| Game Dice Roll | HE | RTP |
| 8, 9, 10 | 16.67% | 83.33% |
| 4, 5, 6 | 16.67% | 83.33% |
| Pairs (2/2, 3/3, 4/4, 5/5) | 11.11% | 88.89% |
| 11 | 11.11% | 88.89% |
| 2, 3, 12 | 11.11% | 88.89% |

TABLE 11

| Late-Play Wager HE and RTP Summary | | |
|---|---|---|
| Point Set | HE | RTP |
| 4 | 6.67% | 93.33% |
| 5 | 4.00% | 96.00% |
| 6 | 1.52% | 98.48% |
| 8 | 1.52% | 98.48% |
| 9 | 4.00% | 96.00% |
| 10 | 6.67% | 93.33% |

Based on the above mathematical analysis a player will experience the range of return to player (RTP) from a minimum value of 98.59%, and approaches a maximum value of 100%, which equates to an HE of 1.41% to 0.00%, when the player places the Play wager, and the maximum More wager whenever a point is set. Such RTP depends at least in part on the More wager limit set by the casino. Conversely a player will experience the lowest RTP when wagering on a single roll 4, 5, 6 side wager or the 8, 9, 10 side wager, having a computed RTP of 83.33% and an HE of 16.67%.

The analysis in the preceding paragraph for the Play and More wagers apply from a "per wager made" perspective, wherein each initial roll corresponds to a wager. If the game is considered from a "per bet (or wager) resolved" perspective, where the push from an initial 7 is not counted as a completed game, then the value of the RTP for the Play wager is 98.30%, corresponding to an HE of 1.70%.

Figure 4:
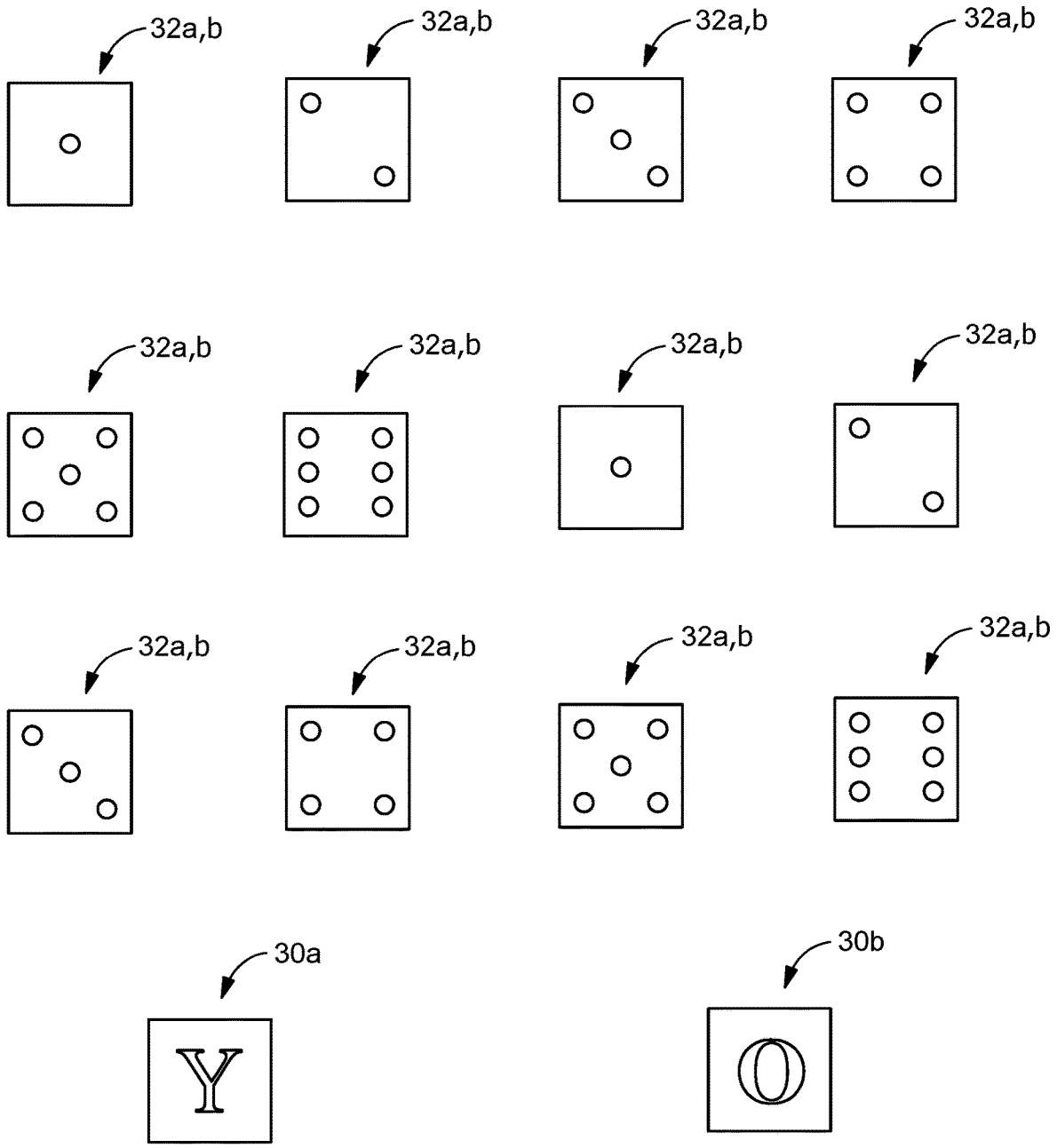
FIG. 4 shows a set of playing cards for playing the board game.

Playing Card Variable—Although this game may be preferably played using four dice as described above—i.e., two sets of dice including one set of casino dice and one set of alpha dice—some jurisdictions do not allow dice to be used to determine a gambling outcome. In an alternate embodiment the game may be played using game playing cards uniquely designed to replace the use of dice where prohibited. In the alternate embodiment the game includes a specialized playing deck of thirty-six playing cards that will be offered to emulate the use of the four-dice in play. See FIG. 4. In another embodiment, cards from two decks of playing cards, may be used. Each deck is distinguishable by a different color. Two suits from the first deck, e.g., diamonds and hearts, are combined with the other two suits, e.g., spade and clubs of the second deck, Collectively the decks include 36 total cards, for example, standard playing cards 1 thru 6 of four separate suits (clubs, spades, diamonds, hearts), plus twelve face cards—Jack, Queen and King—from all four suits for a total of twelve cards that serve the same purpose as the 'Blank cards', equaling 36 total cards of the deck.

Of the 36 cards in this deck, 24 represent all of the values displayed on the four game dice 30*a*, 30*b*, 32*a*, 32*b*. Six cards of the deck of 36 cards will represent one of four dice. This creates four groupings of 6 cards; each grouping is specified on the outside of the card with a distinct color or unique border. Four groupings, four borders, (of the 2 colored playing deck scenario it would be 2 colors, 2 groupings) each a different color and/or may or may not have a (2 deck scenario) uniquely designed border. This deck also has 12 completely blank cards without any border, or by the color of the deck. These blanks are inserted to create a better shuffle, thus creating a nearly full deck and creating a more random mix of the cards.

The dealer shuffles the cards and fans the cards face down on the table. The dealer and players will be able to see all 36 playing cards, 24 cards with the 4 unique borders, and 12 without any border. A random number will be determined between 1 and 6, this will indicate to the dealer which playing cards to pull out of the 36 fanned cards. The dealer will select one card, (based on the random number selected), from each unique border of all 4 groupings (or 2 cards from 2 different colored decks), those 4 cards will then be turned and exposed to the players and cameras to determine the 'roll' or 'call' of the game. Since each uniquely bordered card represents one of the four dice, the combination of the four cards is the equivalent of the four dice. Once the cards are revealed, 2 cards will show actual pictures of dice, (or card values Ace,2,3,4,5,J,Q,K) representing one of the six sides of a dice (1,2,3,4,5,6. Or face cards=zero or blanks) The other two cards representing the alpha dice will be either completely blank, (face cards), or show the letter, Y (5/6 spade/clubs) and/or the letter O (5/6 spade/clubs). Or in the standard playing card version, any 5 or 6 card value together of the spade/clubs draw. Like in the dice version of the game, the [BONUS] 53) only pays when the both playing cards of the Y and O (any combination of 5/6, or 6/5 spade/clubs of second deck) are drawn collectively during any round of play. Otherwise these cards are irrelevant to any 'roll' or 'call' of the game. This playing card format will allow the dealer to draw 4 cards of a deck of 36 cards to determine the outcome of play per round. Should the initial draw of 4 cards (2 and 2) result in any blank card of the playing cards, the dealer will continue to draw until a number (Ace, 2, 3, 4, 5, 6) is drawn to determine 'the call' of 2 cards to equal a dice roll of 2 through 12, representing the game, or bonus dice. The playing cards are then collected, shuffled, and the process repeats as needed.

The novel game described herein is a modified and improved dice and/or card based game. The game does not include many of the conventional wagers in craps, such as: the traditional pass line, don't pass line, hops, horns, hard ways, whirls, the field, single individual rolls of 2,3,12, any seven, craps and eleven (C&E), come bets, i.e., a bet placed after a shooter establishes a point, don't come bets, or fire bets. Such craps bets are well known to those persons skilled in the art. The game has consolidated the best of craps, simplified it by creating a gaming atmosphere that is approachable, fun and player friendly. The game layout 100 hosts comprehensible graphics and text making it easy for users to understand the rules of play, and to learn and play the game.

The embodiment that uses 4 dice as described above is a novel aspect of the disclosed casino game and is within the scope of the invention. In yet another embodiment two separate sets of casino dice may be used, with two separate colors for each set. The first set, (Set A) is of a darker color and represents the game play and 'the call' for each roll. The second set of dice, (Set B) may be distinguishable, e.g., by a lighter color of dice that represents the [BONUS] wager only, and only pays the [BONUS] if a 5/6 or 6/5 rolls.

In an alternate embodiment standard playing cards may be used, e.g., cards 1,2,3,4,5,6 of each standard playing card suit, combined with king, queen, jack of each suit; these cards could be used to represent the 24 dice cards and 12 blank cards, totaling 36 cards in play.

Random Roll Dice Cup

Figure 5:
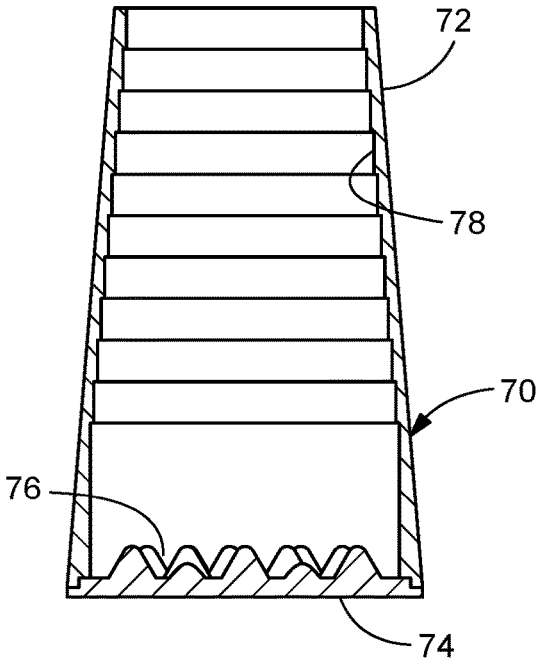
FIG. 5 shows a cross-sectional elevation view of a random roll dice cup of the present invention.

Referring to FIG. 5, in one embodiment, the casino game 100 may include a random roll dice cup 70. The dice cup 70 protects game participants by preventing dice manipulation. Dice cup 70 is preferably a hollow annular shape with an aperture 71 at the first end 72 and a closed end 74 on the bottom, or base, opposite the first end. Dice cup 70 tapers outwardly from first end 72 to closed end 74. The closed end 74 has a wider diameter than the open first end 72 to prevent dice 32*a*, 32*b* from accidentally falling out of the dice cup 70. Dice cup 70 may be approximately 5" to 7" high to accommodate a plurality of dice, although taller or shorter cups may be used depending on the number and size of the dice used in the game, e.g., between 3" and 10". Dice cup 70 may be made from any suitable material, e.g., plastic, resin, polymer, silicon, wood, metal, rubber, leather ceramic, or similar material.

Figure 6:
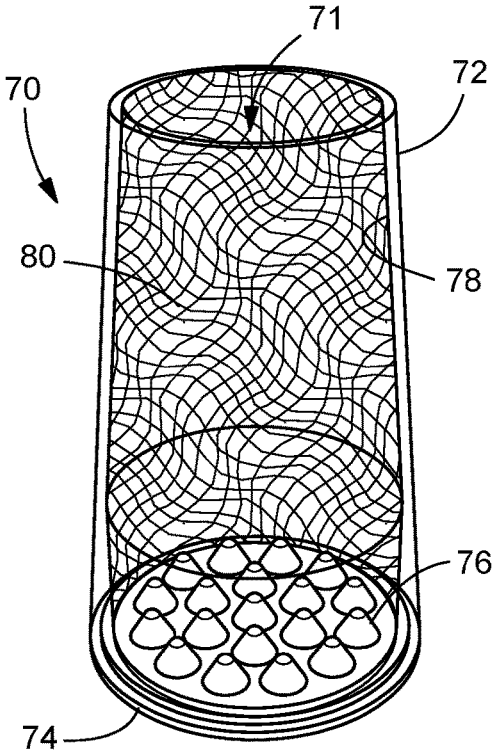
FIG. 6 shows a cross-sectional isometric view of the random roll dice cup.
Figure 7:
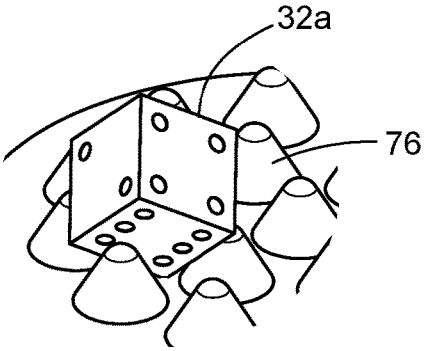
FIG. 7 shows a dice cube resting on protrusions of a dice cup.

Referring next to FIG. 6, a cross-sectional view of the dice cup 70 is shown. In the embodiment shown, dice cup 70 may include conical or pyramid shaped protrusions 76. Protrusions 76 may protrude ⅜ inch from the closed end on the cup inner surface. Protrusions are generally uniform in size. Dimensions of the protrusion for various cups may range from ⅜ inch to ½ inch high. Protrusions 76 cause dice 32*a*, 32*b*, to rest on their corners rather than flat against the bottom, thereby preventing skilled game players from manipulating the dice throw to generate a non-random outcome when expelled from dice cup 70. (See, e.g., FIG. 7) Protrusions 70 may be configured in other geometries, e.g., hemispherical, tetrahedral, or other shapes suitable for the disclosed purpose.

In addition to protrusions on the bottom of dice cup 70, interior walls 78 of dice cup 70 may include surface features 80 that further enhance the randomness of the dice throw. Interior wall surfaces 78 may include, features 80 such as textured, honeycomb, stepped, or woven surfaces, jutting projections, or coarse irregularities. Features 80 cause the dice to tumble from the dice cup 70 rather than just sliding, thus further preventing undesirable control or manipulation by a skilled dice player. Dice cup 70 may be optionally arranged with various combinations of bottom protrusions and sidewall features, e.g., bottom protrusions only, sidewall features only, or bottom protrusions and sidewall features.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the casino table game as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

It should be noted that although the figures herein may show a specific order of method steps, it is understood that the order of these steps may differ from what is depicted. Also two or more steps may be performed concurrently or with partial concurrence. Such variation will depend on the software and hardware systems chosen and on designer choice. It is understood that all such variations are within the scope of the application. Likewise, software implementations could be accomplished with standard programming techniques with rule based logic and other logic to accomplish the various connection steps, processing steps, comparison steps and decision steps.

What is claimed is:

1. A dice cup for rolling one or more cubic dice with differentiated markings on at least two sides of each dice and creating random presentation of an upper side of each dice, the dice cup comprising:

a flat base with a substantially horizontally flat upper surface;

a circumferential side wall with an interior and exterior that forms a hollow annular shape with an aperture at a first end having a first diameter and an opposite second end having a second diameter that attaches to the base to form a closed end, and with the second diameter of the closed second end being greater than the first diameter of the first end, whereby the circumferential side wall tapers outward from the first end to the closed second end; and protrusions extending upward from the substantially horizontally flat upper surface of the base, the protrusions having a predetermined size that cause the one or more cubic dice placed inside the dice cup to rest on a corner of each cubic dice at the substantially horizontally flat upper surface to the base, and not rest on a flat side of each cubic dice, when the flat base of the dice cup is at rest on a table or other horizontal surface;

whereby, when the dice cup is used to roll the one or more cubic dice on a flat surface, the protrusions extending upward from the substantially horizontally flat upper surface of the base and the tapered interior side wall operate to cause the one or more cubic dice to roll and thereby randomize the resulting markings presented on the upper side of each of cubic dice.

2. The dice cup of claim 1, wherein the dice cup further comprises raised surface features on the tapered interior wall of the dice cup, whereby, when the dice cup is used to roll the one or more dice on a flat surface, the raised surface features on the tapered interior wall of the dice cup also contribute to rolling and randomness of the presentation of the markings on the upper surface of the one or more cubic dice.

3. The dice cup of claim 2, wherein the raised surfaces on the tapered interior wall of the dice cup are selected from the group consisting of textured, honeycomb, stepped, or woven surfaces, jutting projections, and coarse irregularities.

4. The dice cup of claim 1, wherein the protrusions extending upward from the substantially horizontally flat upper surface of the base are uniform in geometric shape, with the shape selected from the group consisting of conical, pyramid, hemispherical, and tetrahedral geometries.

5. A dice cup for rolling one or more cubic dice with differentiated markings on at least two sides of each dice and creating random presentation of an upper side of each dice, the dice cup comprising:

a flat base with a substantially horizontally flat upper surface;

a circumferential side wall with an interior and exterior that forms a hollow annular shape with an aperture at a first end having a first diameter and an opposite second end having a second diameter that attaches to the base to form a closed end, and with the second diameter of the closed second end being greater than the first diameter of the first end, whereby the circumferential side wall tapers outward from the first end to the closed second end; and raised features extending from the tapered interior wall of the dice cup;

whereby, when the dice cup is used to roll the one or more dice on a flat surface, the raised surface features on the tapered interior wall operate to cause the one or more cubic dice to roll and thereby randomize the resulting markings presented on the upper side of each of cubic dice; and wherein the dice cup further comprises protrusions extending upward from the substantially horizontally flat upper surface of the base, the protrusions having a predetermined size that cause the one or more cubic dice placed inside the dice cup to rest on a corner of each cubic dice at the substantially horizontally flat upper surface to the base, and not rest on a flat side of each cubic dice, when the flat base of the dice cup is at rest on a table or other horizontal surface, whereby, when the dice cup is used to roll the one or more dice on a flat surface, the protrusions extending upward from the substantially horizontally flat upper surface of the base also contribute to rolling and randomness of the presentation of the markings on the upper surface of the one or more cubic dice.

6. The dice cup of claim 5, wherein the raised surfaces on the tapered interior wall of the dice cup are selected from the group consisting of textured, honeycomb, stepped, or woven surfaces, jutting projections, and coarse irregularities.

7. The dice cup of claim 5, wherein the protrusions extending upward from the substantially flat upper surface of the base are uniform in geometric shape, with the shape selected from the group consisting of conical, pyramid, hemispherical, and tetrahedral geometries.

* * * * *